United States Patent [19]

Sweeny et al.

[11] Patent Number: 4,840,342

[45] Date of Patent: Jun. 20, 1989

[54] PICTURE FRAME STANDOFF

[75] Inventors: Henry D. Sweeny, Kitchener; Antonio D. Sabbadin, Waterloo, both of Canada

[73] Assignee: Swenco Limited, Waterloo, Canada

[21] Appl. No.: 146,028

[22] Filed: Jan. 20, 1988

[51] Int. Cl.[4] ..... A47G 1/16

[52] U.S. Cl. ..... 248/475.1; 248/489; 248/345.1; 40/152; 52/718.1

[58] Field of Search ..... 248/475.1, 345.1, 477, 248/489; 52/716, 718, 312; 40/152

[56] References Cited

U.S. PATENT DOCUMENTS

| | | | |
|---|---|---|---|
| 280,818 | 7/1883 | Hazard | 248/345.1 |
| 1,424,405 | 8/1922 | Haughtor | 248/475.1 X |
| 3,384,987 | 5/1968 | Prechtl | 248/489 |
| 3,606,432 | 9/1971 | Honatzis | 52/716 X |
| 3,856,194 | 12/1974 | Helm | 248/345.1 X |
| 3,938,842 | 2/1976 | Ruhl | 52/716 X |
| 4,274,237 | 6/1981 | Hagstrom | 52/716 X |

FOREIGN PATENT DOCUMENTS

| | | | |
|---|---|---|---|
| 86275 | 9/1958 | Denmark | 52/312 |
| 218832 | 7/1924 | United Kingdom | 248/345.1 |

*Primary Examiner*—Alvin C. Chin-Shue
*Attorney, Agent, or Firm*—Jones, Tullar & Cooper

[57] ABSTRACT

A standoff is provided for use with picture frames having extruded frame members with a rearwardly opening channel. The standoff is lockably engageable with the flanges of the channel and projects rearwardly therefrom so that when the picture is hung on a wall the standoff will engage the wall and space the picture a short distance away therefrom. The standoff has a central wall-engaging portion and a pair of flexible leg portions connected thereto. At the distal end thereof each leg portion has a hook portion for engagement with the flange of the frame member. The hook portion may comprise a groove or a shoulder. The standoff may be injection molded or extruded and is made from a non-slip, non-marring plastic or rubber material.

3 Claims, 3 Drawing Sheets

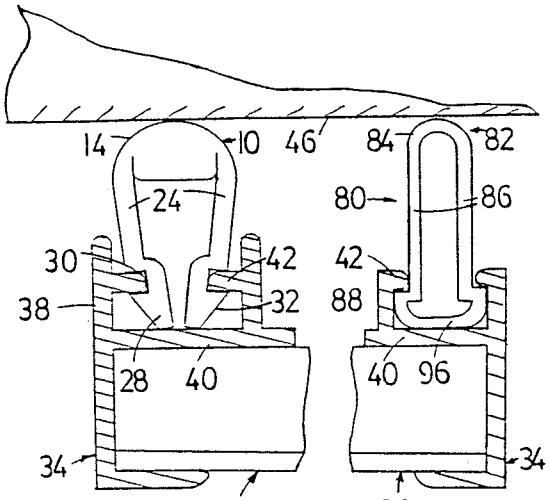
FIG. 10
FIG. 3
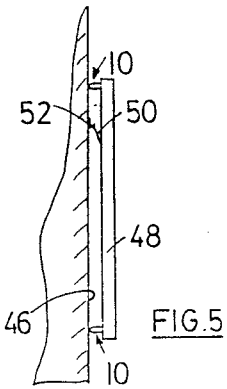
FIG. 5
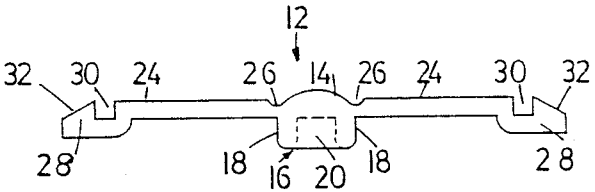
FIG. 1
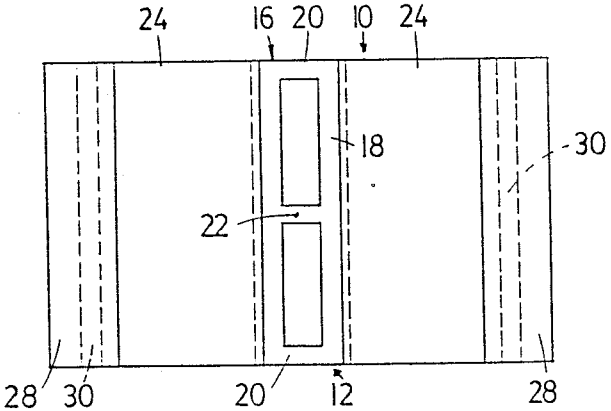
FIG. 2

PICTURE FRAME STANDOFF

This invention relates to a standoff for picture frames, particularly useful for metallic or plastic picture frames in which the frame members are extruded channels having sharp corners.

BACKGROUND OF THE INVENTION

Picture framing is a rapidly growing industry which has been aided and abetted by the development of extruded metallic or plastic frame members which can be cut to any desired length and connected together at the corners by suitable corner connectors. A common feature of such frame members is a generally C-shaped channel extending the length of the frame member with a pair of reentrant flanges separated by a gap. The corner connector is usually positioned within the channels of meeting frame members with access to appropriate fastening or tightening means being provided through the aforementioned gap.

The metallic and plastic frame members presently in use usually have sharp edges or corners which can mar the surface of a wall when a picture is being hung or when it is moved, perhaps during dusting or cleaning. Furthermore, when a picture hangs directly against or close to a wall there is little or no air circulation behind the picture. Research has shown that air circulation is essential in prolonging the life of paintings, pictures, prints, documents, photographs, etcetera and thus it is important to space a picture or painting away from a wall surface.

With solid frames of plastic or wood a spacer or standoff can be used to move the frame out from the wall, the spacer being in the shape of a button, dimple or foot, approximately 3 mm in height, with an adhesive back for attachment to the frame. These spacers do have definite shortcomings in that the adhesive prematurely dissolves, causing the spacer to fall off leaving the frame contaminated with a tacky dirt-collecting film which, if unnoticed, could soil the wall. In addition, the height of about 3 mm is much less than the recommended height of 10–15 mm. Such spacers are even less effective with extruded metallic or plastic frames because of the gap between the flanges at the rear and the fact that the flanges usually do not provide enough surface for proper adhesion of a spacer of the aforementioned variety.

SUMMARY OF THE INVENTION

The present invention overcomes the problems of the prior art by providing a standoff or spacer specifically designed for use with picture frame members having C-shaped channels opening to the rear thereof. The standoff of this invention may be injection molded or it may be extruded and cut to length.

The standoff of this invention includes a central wall-engaging portion and a pair of flexible leg portions connected to the wall-engaging portion. Each leg portion carries a hook portion which in use is engageable with an adjacent flange of the frame member channel. When the hook portions are engaged with the respective flanges the leg portions of the standoff will project rearwardly of the frame with the wall-engaging portion being spaced rearwardly of the frame.

One might place a standoff of the present invention only at the bottom of a picture frame so as to space the bottom out from the wall, especially if the attachment points for the picture-hanging wire or cord are intermediate the vertical extent of the frame. If the attachment points are at the top one might want to position a standoff adjacent each corner of the frame.

The standoff may be molded or extruded from a plastic or rubber material, preferably one having non-skid and non-marring properties, so that the standoffs will keep the picture stationary, even during dusting, and so that it will not mar the wall when the picture is being moved or rehung.

Standoffs may be produced in different heights or configurations to suit different hanging conditions or frame profiles. One might wish, for example to have upper standoffs of a greater height than lower standoffs to achieve an optimum hanging angle.

Standoffs of the same height may be applied at the top and bottom of the frame, providing the illusion of the frame floating in front of the wall rather than resting against the wall. This provides a more pleasing appearance for the art contained in the frame.

Additional features of the present invention will be described hereinbelow and with reference to the drawings.

BRIEF DESCRIPTION OF THE DRAWINGS

FIG. 1 shows an end view of a first embodiment molded standoff in accordance with this invention.

FIG. 2 shows a bottom view of the standoff of FIG. 1.

FIG. 3 shows the standoff of FIG. 1 in position in a picture frame member.

FIG. 5 shows a side view of a typical hung frame using standoffs in accordance with this invention.

FIG. 10 shows the embodiment of FIGS. 8 and 9 in use.

DESCRIPTION OF THE PREFERRED EMBODIMENTS

Figure 4:
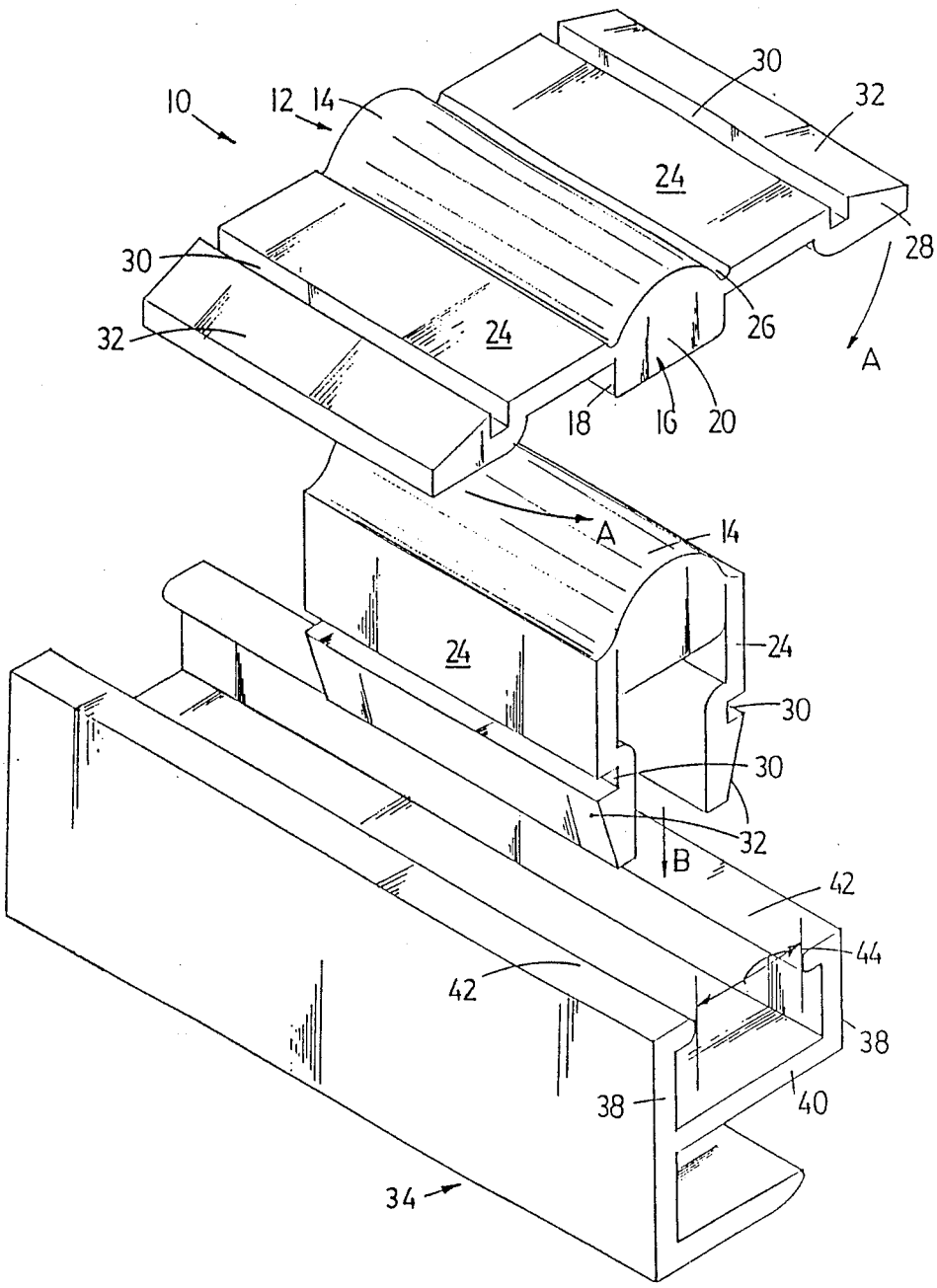
FIG. 4 shows in an exploded view the way in which the first embodiment is used.

FIGS. 1 and 2 show the first embodiment molded standoff 10 of the present invention. The standoff 10 may be injection molded of a suitable plastic or rubber material, selected to have non-skid and non-marring properties.

FIGS. 1 and 2 show the standoff 10 in its asmolded (and purchased) condition while FIG. 3 shows it in its as-used condition.

As seen in FIG. 1 the standoff 10 has a central wall-engaging portion 12 having a transversely convex outer surface 14 and a peripheral, rectangular depending skirt 16. As seen in bottom view 2 the skirt 16 has side wall portions 18, end wall portions 20 and a central transverse rib 22.

Extending outwardly from the central portion 12 are flexible leg portions 24, each joined to the central portion 12 by a living hinge 26 at the junction of the outer surface 14 and the skirt side wall portion 18. At the free end each leg portion 24 has an enlarged section 28 in which there is located an outwardly opening groove 30 running parallel to the side wall portion 18. Outboard of the groove each enlarged portion 28 has a downwardly bevelled surface 32.

FIG. 3 shows a frame member 34 in cross-section, the frame member supporting a picture 36 and having an extruded profile including a rearwardly opening C-shaped channel section defined by side walls 38, inner wall 40 and reentrant flanges 42 separated by a gap or space 44.

With reference to FIGS. 3 and 4 the method of using the standoff of the invention with a frame member 34 will be illustrated and described.

As shown in FIG. 4 one starts with the standoff in its as-molded configuration with the leg portions extending away from the central portion. The leg portions 24 are then pinched inwardly as shown by the arrows A so that each leg portion rotates about its living hinge 26 until the inner surface of each leg abuts the outer surface of the adjacent skirt side wall 18. The enlarged portions 28 may then be pushed into the gap 44 (arrow B) until the bevelled surfaces 32 engage the adjacent flanges 42. Continued inward movement cams the enlarged portions 28 toward each other until the grooves 30 encounter the flanges 42 at which point the enlarged portions 28 spring outwardly with each groove 30 embracing an adjacent flange 42 as shown in FIG. 3. The leg portions 24 are forced outward by the skirt side walls 18 to maintain the grooves 30 and flanges 42 in locking engagement. The standoff is now locked in position and it will space the picture 36 away from the wall 46 by the distance between the outer surface 14 and the flange 42.

The width of the wall-engaging portion 12 and the length of the leg portions 24 can be determined for production purposes by observing the different configurations of frames on the market and designing the standoff accordingly. Several different sizes of standoff could be provided with the customer choosing on the basis of the distance that the frame is to be positioned outward from the wall (typically about 1 cm) and the size of the gap 44 between the flanges 42.

In FIG. 5 the picture frame 48 has standoffs 10 located adjacent each corner, at each end of the upper and lower frame members. The frame is attached to the wall by a wire 50 engaging a wall-mounted hook 52. By using four standoffs of equal height the frame is spaced from the wall by the desired distance and it is parallel to the wall. If the upper standoffs are longer than the lower standoffs then the frame would be held at a fixed angle relative to the wall, facing downwards. This attitude would be desirable for artwork which is hung fairly high on the wall.

Figure 6:
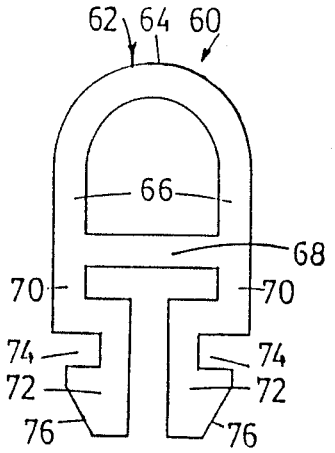
FIG. 6 shows an end view and FIG. 7 shows a side view of a second embodiment extruded standoff in accordance with this invention.
Figure 7:
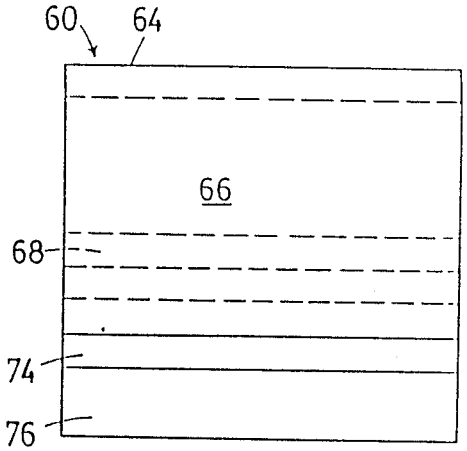

FIGS. 6 and 7 show another embodiment of the invention, the standoff 60 being particularly suited for manufacture by extrusion techniques. The standoff 60 has a wall-engaging portion 62 with a convexly curved transverse outer surface 64 and generally rectangular side walls 66 depending therefrom. A transverse bottom wall 68 extends between the side walls 66. Since the standoff 60 is to be extruded its ends are open, as shown. A flexible leg portion 70 depends from each side wall 66, being an extension thereof, and has an inwardly enlarged portion 72 at the free end thereof. Each enlarged portion 72 has an outwardly facing groove 74 therein and outboard (or downwards) of the groove there is a downwardly and inwardly bevelled surface 76.

The embodiment of FIGS. 6 and 7 is used in essentially the same manner as the first embodiment with the exception that is is not necessary to initially orient the leg portions 70 for entry into the gap 44. One can hold the standoff by gripping the walls 66, insert it into the gap 44 so that contact of the surfaces 76 against the flanges 42 will cam the enlarged portions 72 inwardly, and then release the standoff when the grooves 74 encounter the flanges 42 allowing the leg portions 70 to spring back so that the grooves are engaged with the flanges to hold the standoff in position.

Figure 8:
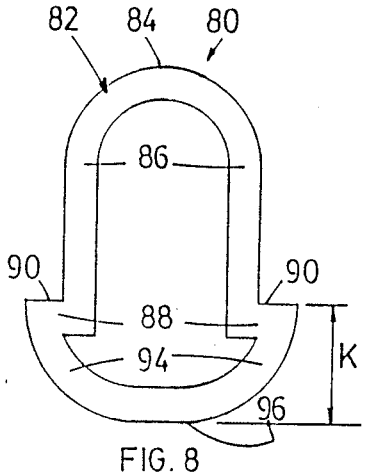
FIGS. 8 and 9 show end and side views of a third embodiment extruded standoff in accordance with this invention.
Figure 9:
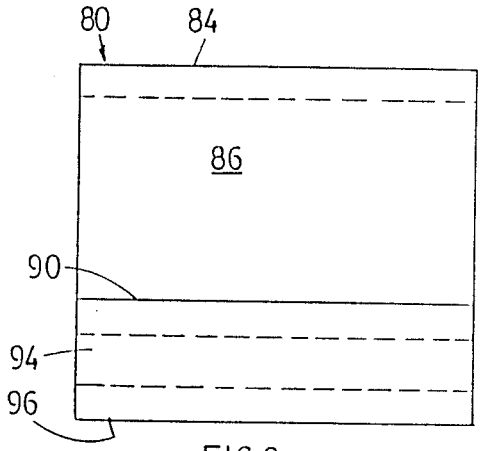

FIGS. 8 and 9 show a third embodiment of this invention, the standoff 80 being also adapted for manufacture by extrusion techniques. The standoff 80 has a wall-engaging portion 82 with a convexly curved transverse outer portion 84 and flexible leg portions 86 depending therefrom, the leg portions being parallel to each other. At the free end of each leg portion 86 a straight shoulder 88 extends outwardly, each shoulder having a flat upper surface 90. A flexible end wall 92 connects the free ends of the shoulders, the end wall 92 having outer arcuate portions 94 curving downwardly and inwardly to a short straight central wall portion 96.

In use (FIG. 10) the leg portions 86 may be squeezed to reduce the width of the standoff 80 sufficiently so that it can be forced between the gap 44 until the shoulders 88 pass the flanges 42. Release of the leg portions 86 allows the standoff 80 to resume its shape of FIG. 8 with the upper surace 90 of each shoulder being positioned against the inner surface of the adjacent flange 42. Preferably the height K (FIG. 8) is equal to or slightly greater than the distance from the wall 40 to the inner surface of the flanges 42 so that the standoff will be wedged in position and will not move in an unwanted manner.

If standoffs in accordance with this invention are to be positioned on frame members prior to assembly of the frame they may be slid into the channel of the appropriate member from the open end thereof with the flanges of the frame member engaging the grooves 30, 74 or the shoulders 88 as the case might be.

The standoffs of the present invention offer an optimum spacing for a frame from a wall; they are essentially permanent as they will not fall off; they can be installed on either a completed frame or they can be installed prior to fabrication; they will not mar a wall and they stabilize the frame relative to the wall, particularly during cleaning; and they are both inexpensive and easy to install.

The present invention provides a standoff for a picture frame that meets all requirements of the homeowner or art gallery. Modifications to the invention are within the skill of a designer without departing from the spirit of the invention and hence the scope of protection to be afforded the invention is to be determined from the appended claims.

The Embodiments of the invention in which an exclusive propery of privilege is claimed are defined as follows:

1. A standoff for use with a picture frame member presenting a generally C-shaped channel profile toward the rear thereof with a pair of coplanar flanges spaced apart by a narrow gap therebetween, said standoff comprising:

a central, wall-engaging portion which includes a transversely arcuate outer surface, first and second sides and first and second ends, a generally rectangular peripheral skirt therebelow having side and end skirt portions connected to said sides and ends of said central portion, and a central transverse rib extending between and connecting said side skirt portions;

a pair of flexible leg portions each extending away from the wall-engaging portion and connected thereto by a living hinge extending along the adjacent side of the wall-engaging portion at the junction of the outer surface and the adjacent side skirt portion; and a groove formed in an enlarged section at the free end of each leg portion and extending parallel to the side skirts of the wall-engaging portion; whereby in use the leg portions may be rotated about the living hinges thereof to bring the free ends together with the grooves facing away from each other such that the free ends may be inserted into the gap between the flanges of the frame member, release of the leg portions allowing them to spring apart so that each groove thereof may engage the adjacent flange to hold the standoff in position, extending rearwardly of the frame member so that said arcuate surface may contact a wall or other surface.

2. The standoff of claim 1 being injection molded of non-skid, non-marring plastic or rubber material.

3. A picture frame and standoff for providing a space between the frame and a wall surface, comprising:

a picture frame member having at least one elongated channel formed at the rear thereof, said channel having a C-shaped profile with a pair of opposed, coplanar, elongated parallel flanges spaced apart by a narrow gap;

a standoff mountable in said channel, said standoff including:

a central, generally rectangular, wall-engaging portion having first and second ends, first and second sides, and a transversely arcuate outer surface, a generally rectangular peripheral skirt therebelow having side and end skirt portions connected to said sides and ends of said central portion, and a central transverse rib extending between and connecting said side skirt portions;

first and second flexible leg portions, each extending transversely away from said central wall-engaging portion and connected thereto by first and second living hinges, respectively, extending along corresponding adjacent sides of said wall-engaging portion at the junctions of said arcuate surface and the adjacent side portions of said peripheral skirt; and a groove formed in an enlarged section at the free end of each leg portion and extending parallel to the side portions of said peripheral skirt, said flexible legs being foldable at said living hinges to rotate said leg portions downwardly to bring the free ends thereof together beneath said central wall-engaging portion with the grooves facing away from each other to enable the free ends to be inserted through said gap between said flanges and into said channel of said picture frame member, said flexible leg members, when folded, engaging said skirt portion adjacent said living hinges to urge said free ends outwardly toward their initial transverse portions, release of said leg portions after insertion of the free ends into the channel allowing them to spring apart to cause each said groove to engage a corresponding adjacent flange to secure said standoff to said picture frame member, said standoff extending rearwardly of the frame member to enable said arcuate surface of said wall-engaging portion to contact a wall surface and to thereby provide a space between the frame member and the wall surface.

* * * * *